US007885551B2

(12) United States Patent
Matsuura et al.

(10) Patent No.: US 7,885,551 B2
(45) Date of Patent: Feb. 8, 2011

(54) TERMINAL APPARATUS, A CONSUMABLES RESIDUAL QUANTITY DISPLAY PROGRAM, AND A RECORDING MEDIUM

(75) Inventors: Hiroki Matsuura, Kanagawa (JP); Yuichi Niwa, Kanagawa (JP); Katsumi Shimokawa, Kanagawa (JP); Masahiro Ogawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 286 days.

(21) Appl. No.: 12/017,700

(22) Filed: Jan. 22, 2008

(65) Prior Publication Data

US 2008/0205908 A1 Aug. 28, 2008

(30) Foreign Application Priority Data

Feb. 26, 2007 (JP) ..... 2007-045714

(51) Int. Cl.
*G03G 15/00* (2006.01)

(52) U.S. Cl. ..... 399/8; 399/23; 399/27; 399/81

(58) Field of Classification Search ..... 399/8, 399/23, 24, 27, 81
See application file for complete search history.

(56) References Cited

U.S. PATENT DOCUMENTS 6,370,341 B1 * 4/2002 Haines ..... 399/24
2002/0071133 A1 * 6/2002 Haines ..... 358/1.13

FOREIGN PATENT DOCUMENTS

JP 02184876 A * 7/1990
JP 11-327383 11/1999

* cited by examiner

*Primary Examiner*—Constantine Hannaher
(74) *Attorney, Agent, or Firm*—Oblon, Spivak, McClelland, Maier & Neustadt, L.L.P.

(57) ABSTRACT

A terminal apparatus, a consumables residual quantity display program, and a recording medium are disclosed. The terminal apparatus, which is connected to a printing apparatus through a network, includes an acquisition unit for acquiring information about consumables of the printing apparatus from the printing apparatus; and a display controller for displaying the information about the consumables, which information is acquired by the acquisition unit, if the information of at least one item of the consumables fulfills a predetermined condition. The display controller may display a no-display specifying screen that prompts a user to specify whether a "no-display" mode should be activated, in which "no-display" mode, displaying the information about the consumables is stopped even if the predetermined condition is fulfilled when the information is to be acquired by the acquisition unit at a next time.

12 Claims, 14 Drawing Sheets

TERMINAL APPARATUS, A CONSUMABLES RESIDUAL QUANTITY DISPLAY PROGRAM, AND A RECORDING MEDIUM

BACKGROUND OF THE INVENTION

1. Field of the Invention

The present invention generally relates to a terminal apparatus, a consumables residual quantity display program, and a recording medium; and especially relates to a terminal apparatus for displaying a residual quantity of consumables, a computer-readable consumables residual quantity display program, and a recording medium for storing the program.

2. Description of the Related Art

Printing apparatuses (printers) use consumables such as a toner and sheets of paper. When the quantity of one of the consumables becomes small, a user replenishes the supply of that consumable. Various inventions concerning management of the quantities of the consumables have been made.

Patent Reference JPA H11-327383 discloses a recording apparatus wherein a blanket process of providing warning is carried out if a "near-end" or an "end" situation of the consumables is detected. Here, the "near-end" is the case wherein the residual quantity becomes less than a predetermined threshold value, that is, the consumables are almost running out; and the "end" is the case wherein the consumables have run out. Specifically, if the residual quantity of the toner, for example, is approaching nil ("near-end"), or has reached nil ("end"), a user is notified.

Further, if the residual quantity of stacked paper is approaching nil or has reached nil, warning can be provided by, e.g., SNMP (Simple Network Management Protocol).

However, in the recording apparatus disclosed by Patent Reference 1, if the residual quantity of the consumable is in the "end" or "near-end" state, warning is provided in a blanket manner, that is, every time the "end" or "near-end" state is detected, warning is repetitively provided, which is annoying and troublesome. In other words, the conventional technique has a problem in that the consumables residual quantity information is not effectively provided to the user.

SUMMARY OF THE INVENTION

In view of the problem described above, the present invention offers a terminal apparatus for effectively displaying consumables residual quantity information, a consumables residual quantity display program, and a computer-readable recording medium.

That is, the present invention provides a terminal apparatus, a consumables residual quantity display program, and a computer-readable recording medium that substantially obviate one or more of the problems caused by the limitations and disadvantages of the related art.

Features of embodiments of the present invention are set forth in the description that follows, and in part will become apparent from the description and the accompanying drawings, or may be learned by practice of the invention according to the teachings provided in the description. Problem solutions provided by an embodiment of the present invention may be realized and attained by a terminal apparatus, a consumables residual quantity display program, and a computer-readable recording medium particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the invention provides a terminal apparatus for effectively displaying consumables residual quantity information, a consumables residual quantity display program, and a computer-readable recording medium as follows.

An aspect of the embodiment of the present invention provides a terminal apparatus that is capable of communicating with a printing apparatus connected to the terminal apparatus through a network. The terminal apparatus includes an acquisition unit for acquiring information about consumables of the printing apparatus from the printer, and a display controller for displaying the information about the consumables, if the information, which is acquired by the acquisition unit, about at least one item of the consumables fulfills a predetermined condition, and for displaying a no-display specifying screen in which a user can specify that a further display of the information about the consumables be stopped even if at least one item of the consumables fulfills the predetermined condition.

According to another aspect of the embodiment, the information about the consumables, which information is acquired by the acquisition unit, includes a residual quantity of toner of the printing apparatus, and a residual quantity of stacked paper in a paper feed tray of the printing apparatus; further, the predetermined condition is that at least one of the residual quantities of the consumables be less than a predetermined threshold value.

According to another aspect of the embodiment, the terminal apparatus is connected to a consumables inventory control apparatus through the network. The consumables inventory control apparatus is for storing and managing inventory information about the consumables. Further, the acquisition unit acquires the inventory information about the consumables stored in the consumables inventory control apparatus from the consumables inventory control apparatus, and the display controller displays the inventory information about the consumables, which inventory information is acquired by the acquisition unit.

According to another aspect of the embodiment, the terminal apparatus includes a no-display specifying unit for activating a "no-display" mode based on an input of the user into the no-display specifying screen provided by the display controller. When the "no-display" mode is activated, the information about the consumables is not displayed. Further, the no-display specifying unit cancels the "no-display" mode if the printing apparatus provides the acquisition unit with further information that the consumables of the printing apparatus have been resupplied (are in normal supply).

According to another aspect of the embodiment, the display controller is configured so that the information about the consumables acquired by the acquisition unit may be displayed according to a predetermined rule even if the no-display mode is activated by the no-display specifying unit.

Another aspect of the embodiment of the present invention provides a consumables residual quantity display program for a computer to execute a process carried out by the above-described functional units of the terminal apparatus.

Another aspect of the embodiment of the present invention provides a recording medium for storing the consumables residual quantity display program, which recording medium is computer readable and executable.

According to the terminal apparatus, the consumables residual quantity display program, and the recording medium of the embodiment of the present invention, the residual quantity information about the consumables can be effectively displayed.

DESCRIPTION OF THE PREFERRED EMBODIMENTS

In the following, Embodiments of the present invention are described with reference to the accompanying drawings. Although Embodiments are described wherein a terminal apparatus is realized by a PC (Client PC) 1, which is a common computer apparatus, this is for example only. The present invention is applicable to other terminal apparatuses, not restricted to the PC 1.

Embodiment 1

Hereafter, Embodiment 1 of the present invention is described with reference to FIGS. 1 through 8.

(Network Configuration)

First, an example of a terminal apparatus according to Embodiment 1 of the present invention is described with reference to FIG. 1, wherein a Client PC such as 1A, 1B, and 1C serves as the terminal apparatus.

Figure 1:
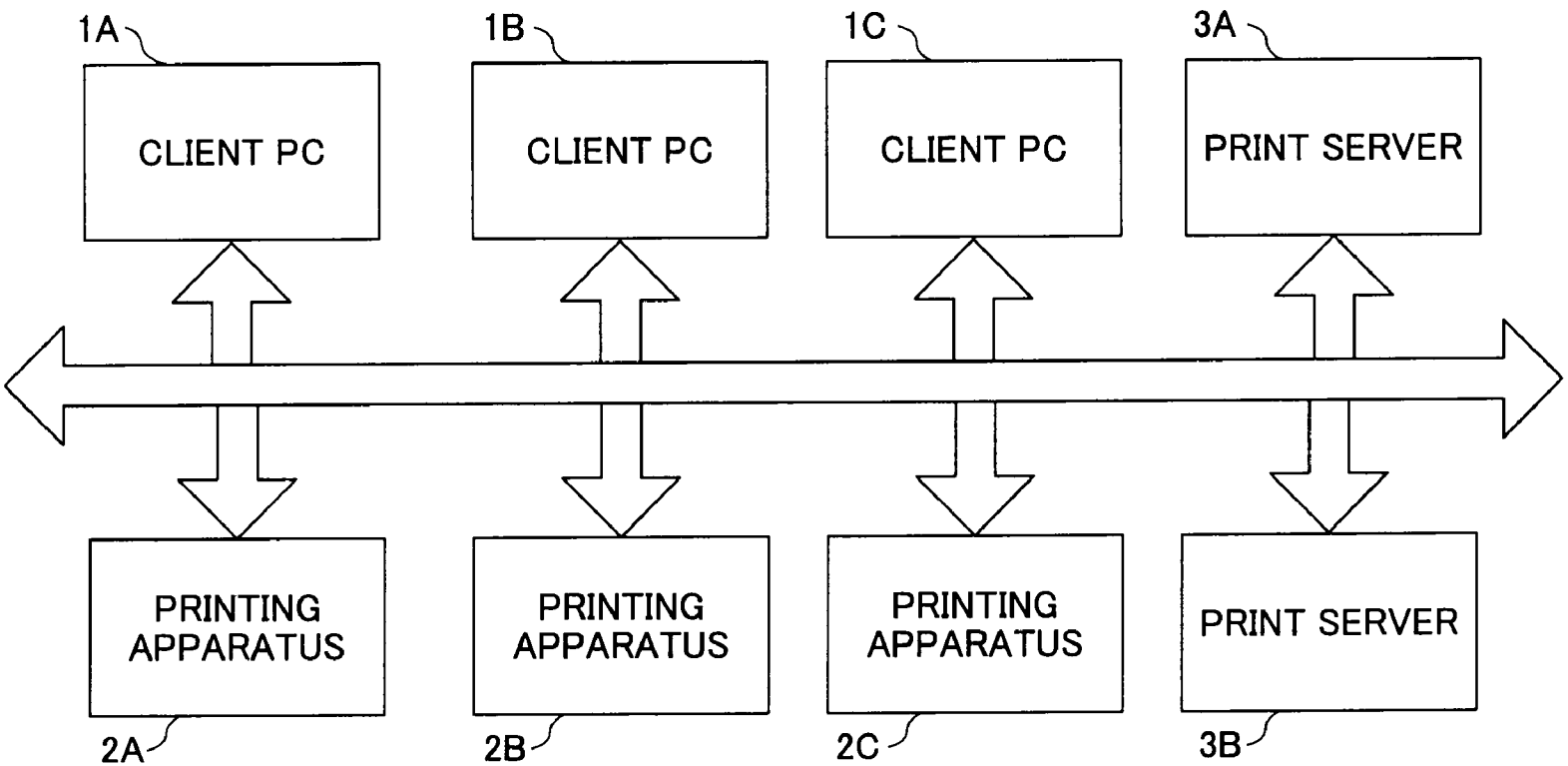
FIG. 1 is a block diagram of an example of a network configuration according to Embodiment 1.

In FIG. 1, a system according to Embodiment 1 includes one or more Client PCs such as 1A, 1B, and 1C connected through a network such as a LAN. The PCs are generically called Client PC 1. The system further includes Printing Apparatuses such as 2A, 2B, and 2C. The Printing Apparatuses are generically called Printing Apparatus 2. The system further includes Print Servers such as 3A and 3B. The Print Servers are generically called Print Server 3.

The Client PC 1 is a common computer apparatus including a CPU (Central Processing Unit), a RAM (Random Access Memory), and a ROM (Read Only Memory) that are not illustrated.

The Printing Apparatus 2 is a common printing apparatus including an image formation unit (not illustrated) for forming an image for a printing output, and an output unit (not illustrated) for providing the printing output. The Printing Apparatus 2 may be a MFP (Multi Function Printer), and the like. Further, the Printing Apparatus 2 may be any apparatus that uses consumables such as toner and stacked paper.

The Print Server 3 is a common computer apparatus including a CPU, a RAM, and a ROM, which are not illustrated. The Print Server 3 preferably includes a cache function for receiving and temporarily storing printing output data from the Client PC 1.

Configured as described above, the Client PC 1 transmits the printing output data to the Print Server 3, the Print Server 3 receives the printing output data and transmits printing directions to the Printing Apparatus 2 based on the printing output data, and the Printing Apparatus 2 provides a printing output based on the printing directions.

(Configuration Example of Client PC)

Next, an example configuration of the Client PC 1 according to Embodiment 1 is described with reference to FIG. 2.

Figure 2:
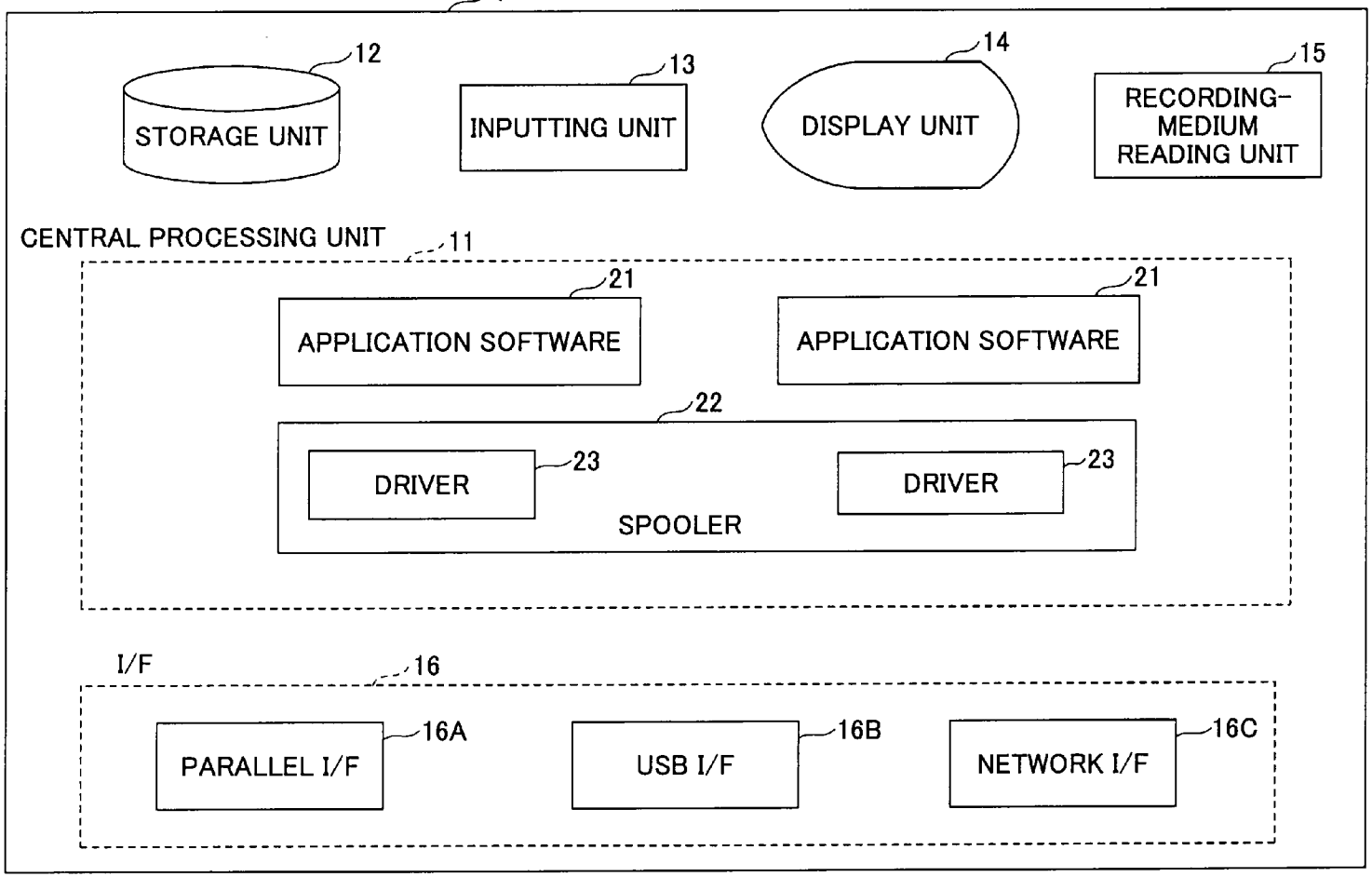
FIG. 2 is a block diagram of an example of a Client PC 1 according to Embodiment 1.

As shown in FIG. 2, the Client PC 1 includes a central processing unit 11, a storage unit 12, an inputting unit 13, a display unit 14, a recording-medium reading unit 15, and an I/F 16, which are connected by a bus that is not illustrated.

The central processing unit 11 is for controlling information and for processing operations, and performs informational control and informational operations based on information stored in the storage unit 12. The central processing unit 11 processes based on software stored in the storage unit 12, which software includes application software 21, a spooler 22, and a driver 23 (printer driver in this case). Here, the software as described above operates on an operating system, such as Windows®, which runs on the Client PC 1, which operating system is beforehand stored in the storage unit 12 with other software. The central processing unit 11 executes the software by calling the software from the storage unit 12.

The storage unit 12 is for storing information, and includes a non-volatile storage such as a hard disk, and a volatile storage such as RAM. The inputting unit 13 is for a user to input information, and is realized by, for example, a keyboard, a touch panel, a pointing device such as a mouse, and a voice input device.

The display unit 14 is for displaying information, and is, for example, a CRT (Cathode Ray Tube), an LCD (Liquid Crystal Display), or an LED (Light Emitting Diode) display. The recording-medium reading unit 15 may be, for example, a floppy disk drive, a CD drive, or a DVD drive for reading a recording medium such as a floppy disk, a CD-ROM disk, or a DVD-ROM disk, respectively.

The I/F 16 is an input/output interface for inputting and outputting information from/to an external source. The I/F 16 includes a Parallel I/F 16A for interfacing based on the IEEE 1284 specification, a USB I/F 16B for interfacing based on the USB specifications USB 1.0 and 2.0, and a Network I/F 16C for interfacing with an Ethernet (trademark) LAN.

The Application software 21 is such as documentation software, spreadsheet software, image creation/edit/processing software, and business software. The spooler 22 is a software module for managing a printing function of the operating system such as Windows®. The printer driver 23 operates as a part of the spooler 22, and is for controlling the Printing Apparatus 2.

With the configuration described above, the user draws up a document to be printed using the application software 21 on the Client PC 1. When printing the document is desired, the user inputs a printing direction to the application software 21, and printing is carried out as follows.

When the application software 21 receives the printing direction, the application software 21 transmits the document (drawing information) to be printed to the printer driver 23. The printer driver 23 generates a command (printing data for the Printing Apparatus 2) required of the Printing Apparatus 2 for interpreting and generating an actual printing image.

The generated printing data for the Printing Apparatus 2 are transmitted to the Printing Apparatus 2 through a suitable I/F 16 based on printer configuration information held by the spooler 22. For example, when the Printing Apparatus 2 is connected through the network, the generated printing data are transmitted to the Printing Apparatus 2 via the network through the network I/F 16C. The Printing Apparatus 2 interprets the received printing data, and prints a suitable image on a printing medium such as paper.

(Configuration of Consumables Residual Quantity Display Software)

Next, a configuration example of consumables residual quantity display software 21A of the Client PC 1 according to Embodiment 1 is described with reference to FIG. 3. Here, the consumables residual quantity display software 21A is one component of the application software 21 shown in FIG. 2. The consumables residual quantity display software 21A is for displaying residual quantity information about consumables such as toner and stacked paper in a paper feed tray of the Printing Apparatus 2.

Figure 3:
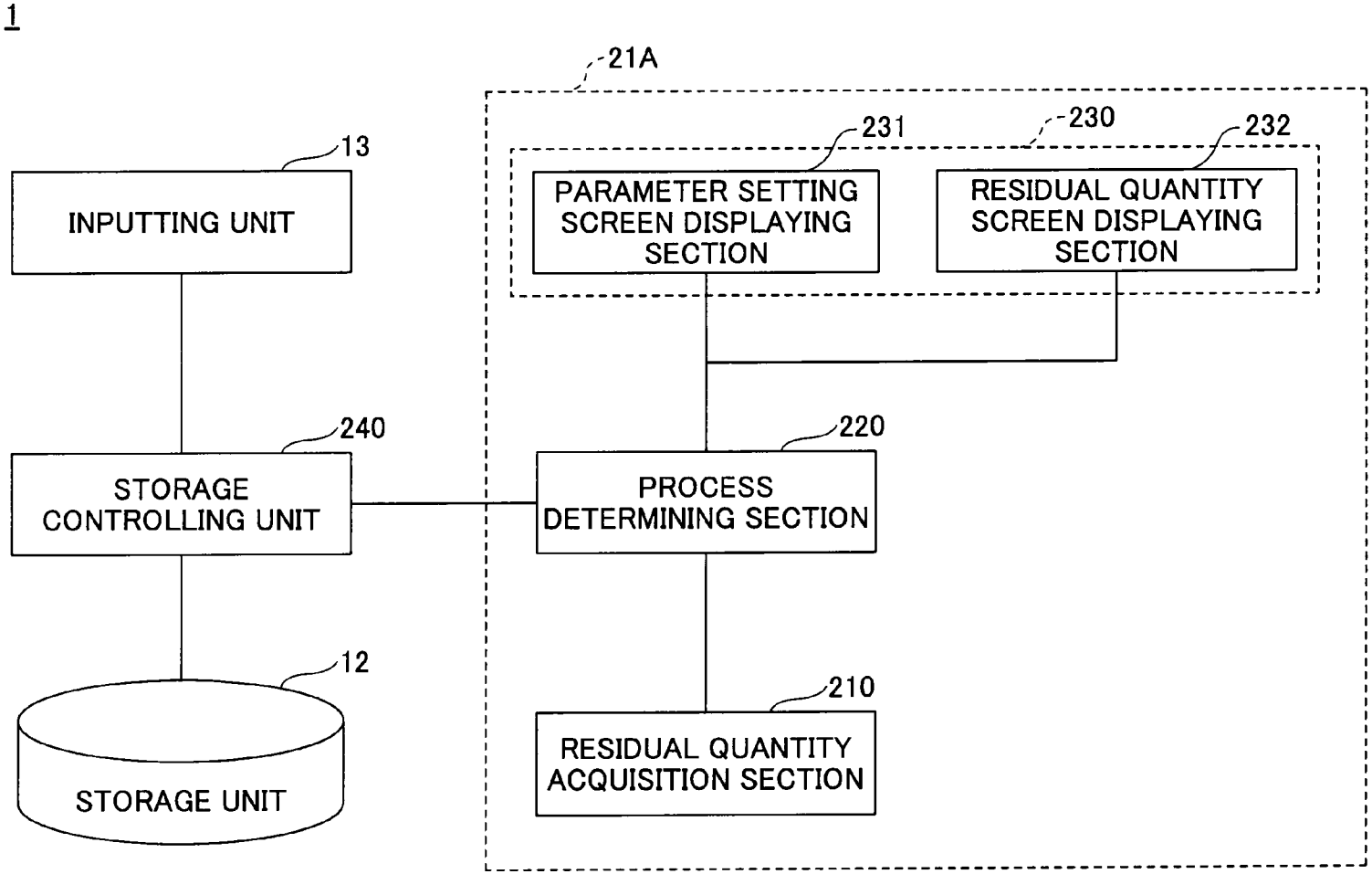
FIG. 3 is a block diagram of an example of consumables residual quantity display software of the Client PC 1 according to Embodiment 1.

As shown in FIG. 3, the consumables residual quantity display software 21A includes a residual quantity acquisition section (acquisition section) 210, a process determining section 220, and a display control section 230. Here, the display control section 230 includes a parameter setting screen displaying section 231, and a residual quantity screen displaying section 232.

The residual quantity acquisition section 210 acquires information about the consumables from the Printing Apparatus 2, for example. The information includes the residual quantity of the toner of applicable colors, and the residual quantity of the stacked paper of applicable sizes stored in the paper feed tray of the Printing Apparatus 2.

The process determining section 220 determines a process to be performed (which process is concerning displaying information about consumables) according to the information about the consumables acquired by the residual quantity acquisition section 210. Details of the process are described below with reference to FIG. 6, where a residual quantity display condition determining operation is described.

The display control section 230 includes the parameter setting screen displaying section 231 and the residual quantity screen displaying section 232, and performs display control of the display unit 14 of the Client PC 1.

Figure 8:
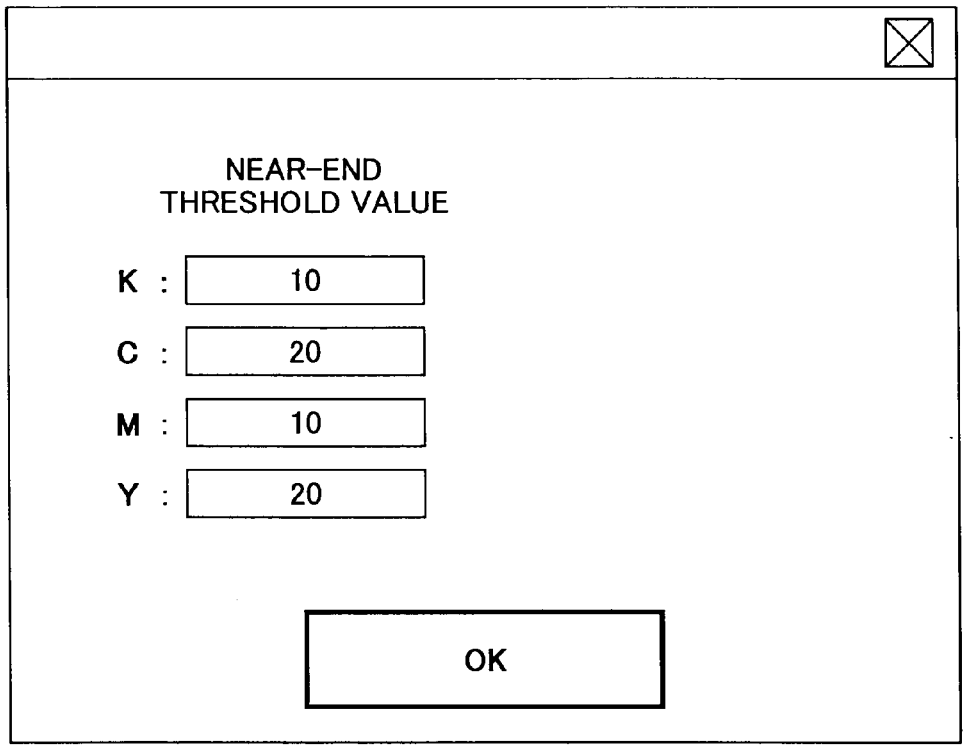
FIG. 8 is a schematic diagram of an example of a screen provided by a parameter setting screen displaying section 231 according to Embodiment 1.

The parameter setting screen displaying section 231 displays a screen for setting various parameters. For example, the screen appears as shown in FIG. 8, wherein the parameters are "near-end" threshold values for different toner colors. Details are described below. Here, the screen may contain an interface for prompting an input or a change of the parameter value. The screen that contains such an interface is henceforth called a parameter changing screen.

Figure 9:
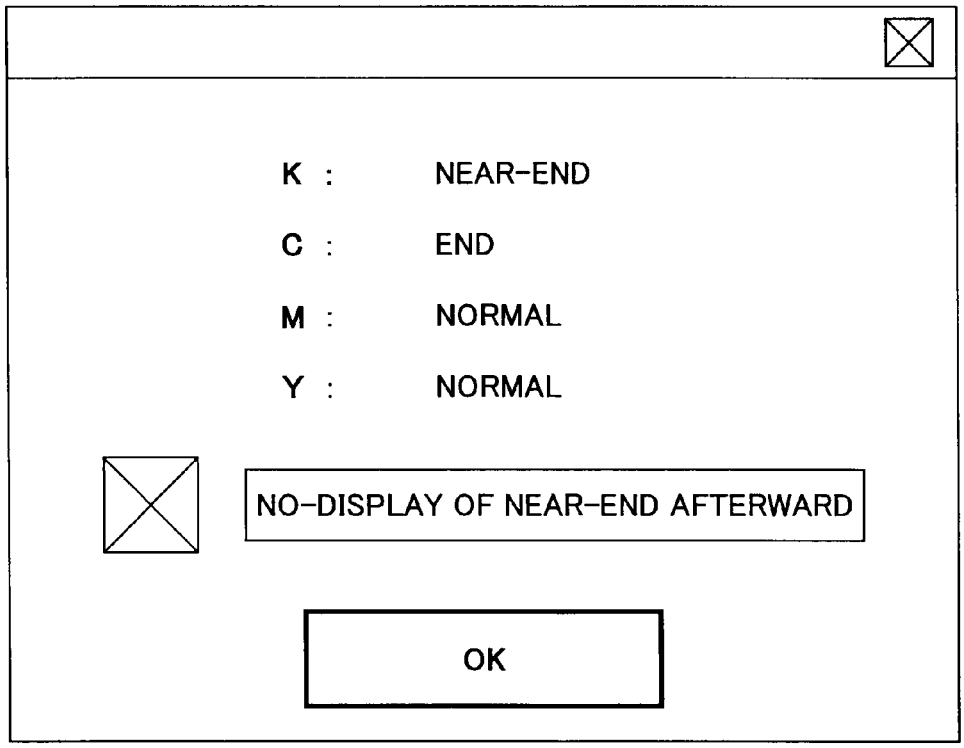
FIG. 9 is a schematic diagram of an example of a screen provided by a residual quantity screen displaying section 232 according to Embodiment 1.

The residual quantity screen displaying section 232 is for displaying information about the consumables, typically, the residual quantity of the consumables, here. For example, information concerning the status of the residual quantity of each toner is displayed as shown in FIG. 9. Details of the displayed information are described below. Further, in the display screen of the residual quantity of the consumables, an interface for activating a no-display mode for the residual quantity of the consumables from the next time is provided. The screen containing such an interface is henceforth called a no-display specifying screen. Details are described below.

The Client PC 1 includes a storage controlling unit 240. The storage controlling unit 240 is for controlling the data stored in the storage unit 12. In other words, the storage controlling unit 240 controls the contents stored in the storage unit 12. For example, the storage controlling unit 240 controls reading and writing data in the storage unit 12.

With the configuration described above, the residual quantity acquisition section 210 of the consumables residual quantity display software 21A acquires the residual quantity information about the consumables from the Printing Apparatus 2. The process determining section 220 determines the process to be performed (which process is concerning displaying information about consumables) based on the acquired residual quantity of the consumables. The parameter setting screen displaying section 231 and the residual quantity screen displaying section 232 carry out display according to the determination of the process determining section 220.

The consumables residual quantity display software 21A can be invoked, e.g., by directly specifying a directory where the software is stored, and by pointing at and clicking on an icon displayed on the display unit 14 of the Client PC 1.

The consumables residual quantity display software 21 A described above may be stored in a recording medium such as a CD-ROM disk, a DVD-ROM disk, and a floppy disk as one or more files. The software is installed in the Client PC 1 by reading the recording medium with the recording-medium reading unit 15, and copying the software in a format applicable to the storage unit 12. Here, the software may be supplied through a transmission line such as a communication circuit or a network.

Here, the functions realized by the consumables residual quantity display software 21A may be included as functions of the printer driver 23 (FIG. 2). When the functions are included in the printer driver 23, the functions can be performed by inputting a direction on the screen provided by the printer driver 23. In this case, although execution of the software is asynchronous with reference to the printing direction, it can be arranged for the execution of the software to be synchronous wherein the software is invoked when a printing direction of data generated by the application software 21 is provided.

Further, the functions of the consumables residual quantity display software 21A may be realized by the Print Server 3 of FIG. 1. This arrangement is suitable, for example, when offering the functions of the consumables residual quantity display software 21A in network environments such as the Web. Furthermore, the functions may be realized by the Printing Apparatus 2 shown in FIG. 1. In this case, the residual quantities can be displayed on a console panel of the Printing Apparatus 2, which can be convenient when a copying operation takes place.

(Outline of the Consumables Residual Quantity Display)

Figure 4:
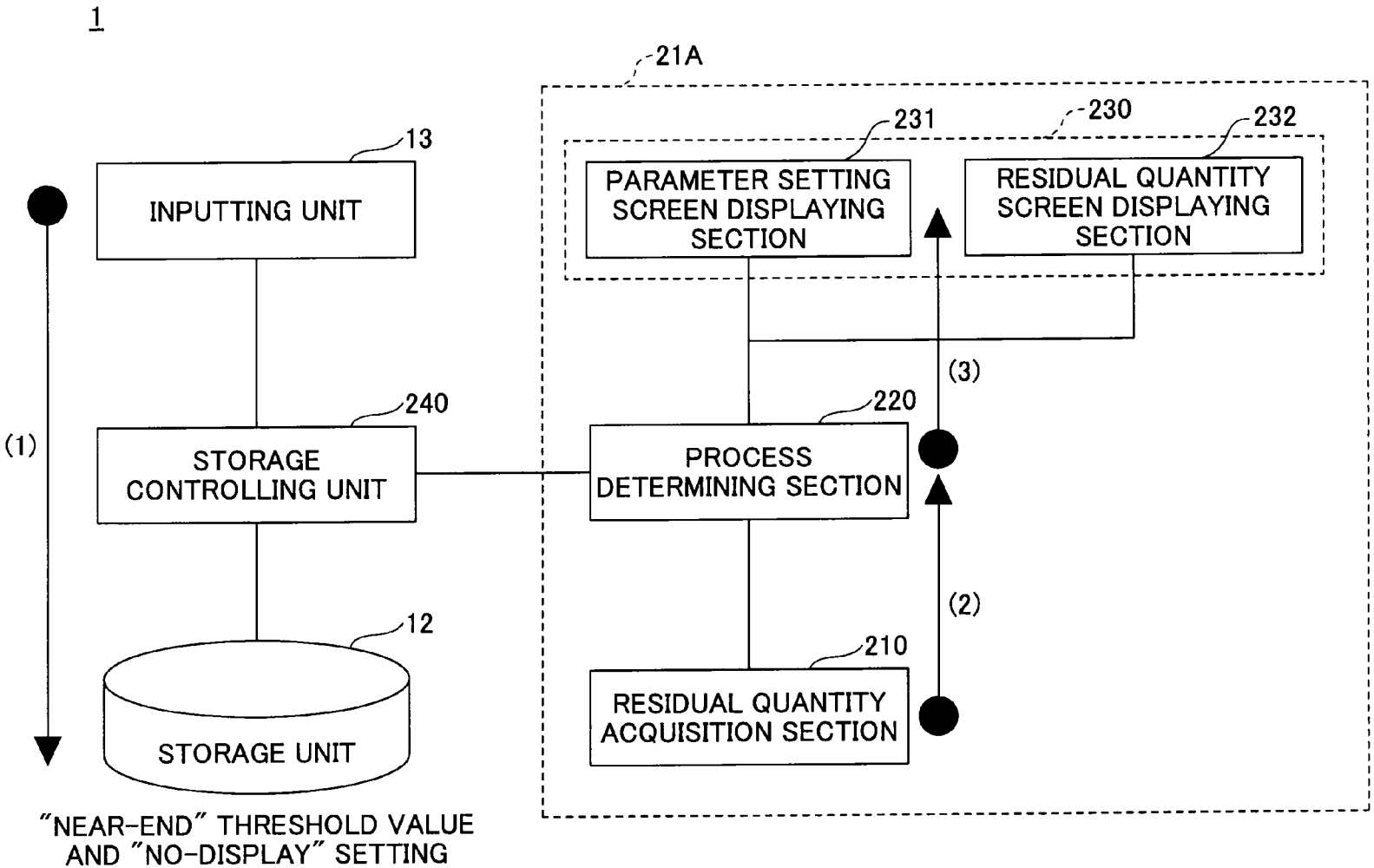
FIG. 4 is a block diagram showing the outline of consumables residual quantity display according to Embodiment 1.

Next, in advance of describing an example of the functions of the consumables residual quantity display software 21A of FIG. 3, the outline of the consumables residual quantity displaying is described with reference to FIG. 4.

The consumables residual quantity displaying according to Embodiment 1 includes three major operations, namely, (1) parameter changing operation, (2) residual quantity display condition determining operation, and (3) residual quantity display operation. The operations (1) through (3) are described below with reference to FIGS. 5 through 7.

Here, before describing the operations (1) through (3), setup information used in the consumables residual quantity displaying is described. Information to be set up (the setup information) includes a "near-end" threshold value and a "no-display" mode (or "no-display" mode value setting), which information is stored in the storage unit 12, and the like. Details follow.

First, the "near-end" threshold value is described. The "near-end" threshold value is a predetermined threshold value for defining a status of the residual quantity of the consumables. According to Embodiments, the status of the residual quantity is defined by three levels, namely, a normal state (residual quantity>predetermined threshold value), the "near-end" state (0<residual quantity <=predetermined threshold value), and an end state (residual quantity=0).

When the consumables are toners, the "near-end" threshold value is selected for each kind of toner such as black (K), cyan (C), magenta (M), and yellow (Y) colors. Further, when the consumables are the stacked paper in the paper feed trays, the "near-end" threshold value is defined for each size of the stacked paper such as A4, B4, and A3. In this way, the "near-end" threshold value is defined for each kind of desired consumable so that the state of the residual quantity of each of the desired consumables can reflect, e.g., a use frequency of the corresponding consumable.

Next, specifying "no-display" (no-display setting) is described. When "no-display" is specified, a "no-display" mode is activated wherein the residual quantity of the consumable is not displayed. If the "no-display" mode is not specified, the "no-display" mode is cancelled so that the residual quantity of the consumable is displayed. In this way, unwanted displays can be stopped. The "no-display" mode can be activated for each of the consumables. Further, the "no-display" mode may be specified for each state of the residual quantities of the consumables, such as the "near-end" and "end" states.

(Example 1 of the Consumables Residual Quantity Display Operation)

The first example of operations (1) through (3) is described with reference to FIGS. 5 through 9.

Here, it is presupposed that the consumables residual quantity display software 21A is invoked for the first time. The "near-end" threshold value used in the consumables residual quantity display can be provided by the user. Further, since this is the case where the software is invoked for the first time, the "no-display" of the residual quantity of the consumables is not specified, i.e., de-activated.

((1) Example of a Parameter Changing Operation)

Figure 5:
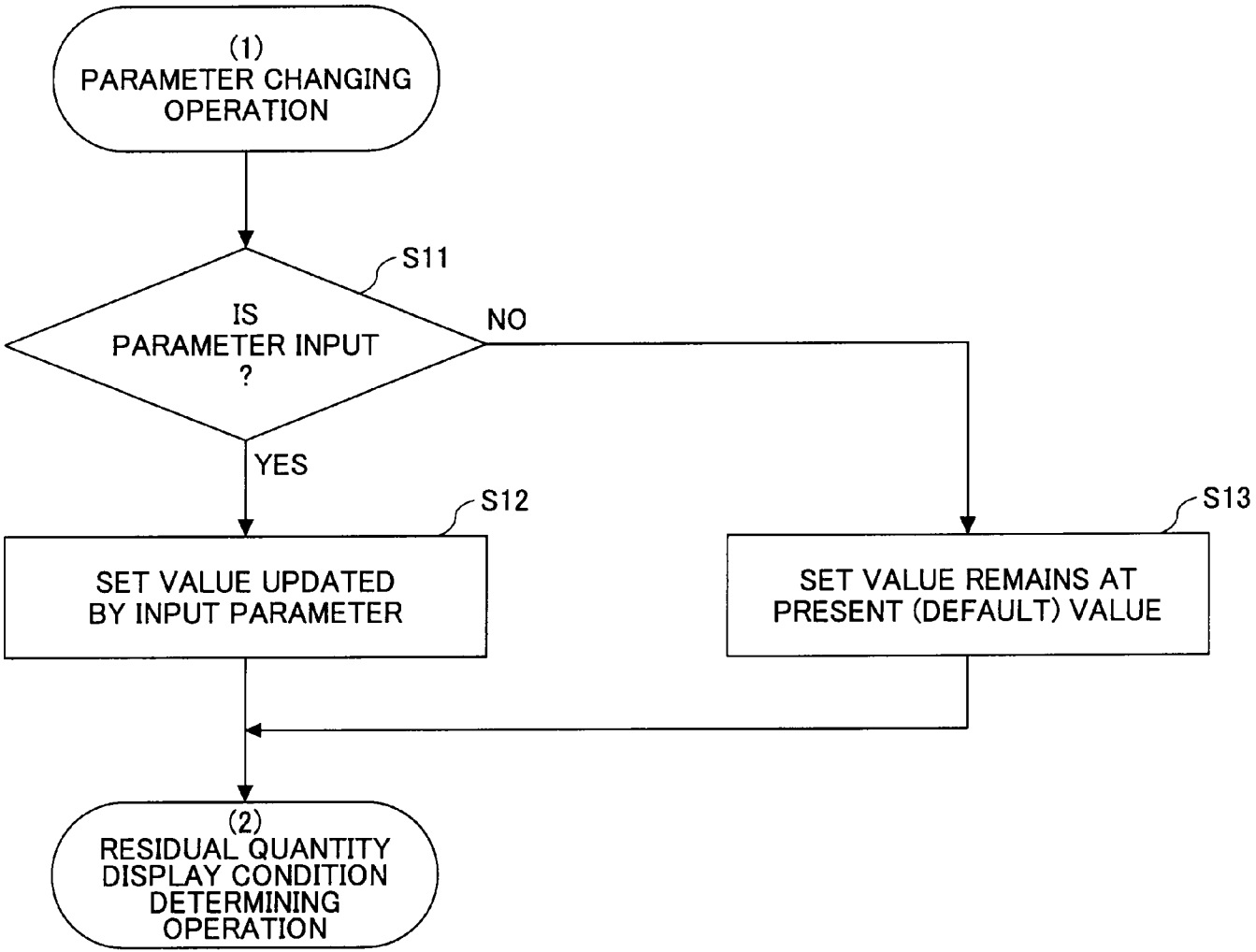
FIG. 5 is a flowchart of (1) a parameter changing operation according to Embodiment 1.

An example of the operation of changing a parameter (setup information) is described with reference to FIG. 5. Here, the operation is to change the setup information stored in the storage unit 12 according to an input by the user. Setting a "near-end" threshold value is described as an example; however, the operation is not limited to the "near-end" value.

First, a parameter is provided to the inputting unit 13 (S11). Here, when the user wishes to change the "near-end" threshold value, the user is to input a new value to the inputting unit 13 when a parameter changing screen (FIG. 8) is displayed. The parameter changing screen shown in FIG. 8 is an example of the screen displayed by the parameter setting screen displaying section 231. Details are described below at (3) residual quantity display operation.

When a value is input at step S11 (YES at S11), the process moves to step S12 where the storage controlling unit 240 updates the "near-end" threshold value stored in the storage unit 12 with the value input at step S11 (S12).

When no input is made at step S11 (NO at S11), the process moves to step S13 where the storage controlling unit 240 finishes the process without changing the "near-end" threshold value then stored in the storage unit 12 as a standard value or a default value (S13). In addition, when there is no "near-end" threshold value which can change a value, the same process as step S13 is performed.

By the processes above, the setup information stored in the storage unit 12, for example, the "near-end" threshold value in the present example, is updated based on the input by the user.

(Example of (2) the Residual Quantity Display Condition Determining Operation)

Figure 6:
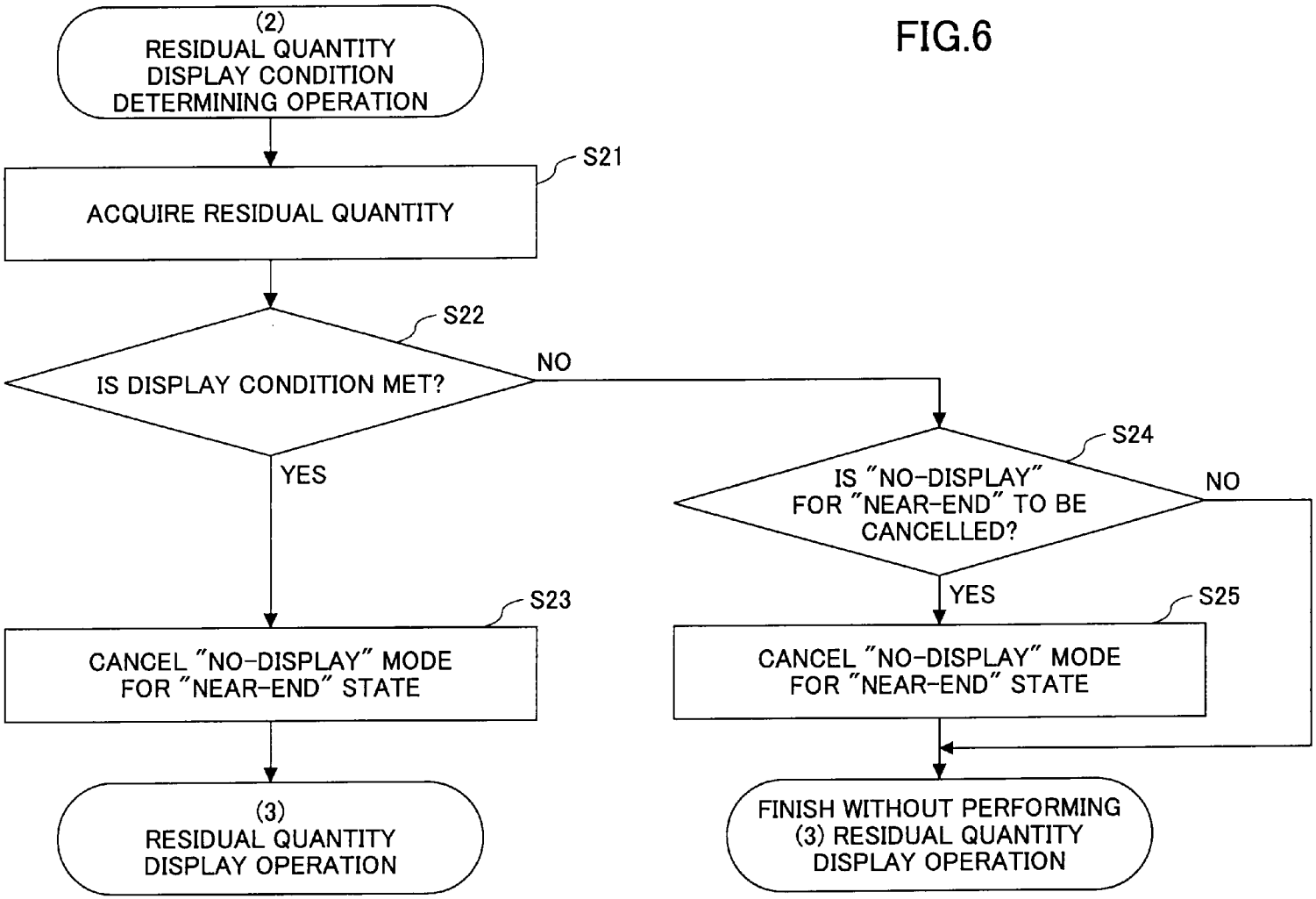
FIG. 6 is a flowchart of (2) a residual quantity display condition determining operation according to Embodiment 1.

An example of an operation for determining whether information about the consumables is to be displayed is described with reference to FIG. 6. Here, the operation is for determining whether the information about the consumables acquired from, e.g., the Printing Apparatus 2 is to be displayed, and the determination is made based on the set-up information stored in the storage unit 12. The information about the consumables is, for example, the residual quantity of the toners of four colors (K, C, M, and Y). The information about the consumables may be the residual quantity of the stacked paper in the paper feed tray, and others.

First, the residual quantity acquisition section 210 acquires the residual quantity of the consumables from the Printing Apparatus 2 (S21). Here, in this example, the residual quantities of the toner of four colors (K, C, M, Y) of the Printing Apparatus 2 are acquired when printing is carried out.

Then, the process determining section 220 determines whether at least one of the residual quantities acquired at step 21 fulfills a condition to display (i.e., in one of the "near-end" and "end" states) (S22). Here, the residual quantities of the toners are compared with corresponding "near-end" threshold values stored in the storage unit 12 (it is also determined whether the toner residual quantity is zero). If one or more toners are in one of the "near-end" and "end" states (YES at S22), it is determined that the state should be displayed to notify the user, and the process moves to step S23. If the residual quantities of all the toners are greater than the corresponding threshold values (NO at S22), which is a normal state, the process moves to step S24.

At step S23, the storage controlling unit 240 cancels the "no-display" mode concerning the "near-end" state of the residual quantity of the consumables stored in the storage unit 12 (S23). Here, since the "no-display" mode at the "near-end" state is already de-activated, the process is finished without changing the mode.

At step S24, the process determining section 220 determines whether a condition to cancel the "no-display" mode ("no-display" canceling condition) in the "near-end" state is met (S24). If it is determined that the "no-display" canceling condition is met (YES at S24), the process moves to step S25. If it is determined that the "no-display" canceling condition is not met (NO at S24), the process is finished without changing the mode. The "no-display" canceling condition is a condition wherein a "no-display" mode stored in the storage unit 12 is to be canceled. For example, the condition is that the residual quantities of all the toners are normal (in normal supply), that is, greater than the corresponding "near-end" threshold values.

At step S25, the storage controlling unit 240 cancels the "no-display" mode for the "near-end" state of the residual quantity of the consumables, which mode is stored in the storage unit 12 (S25), and then the process is finished. As described above, when all the toners are in normal supply, for example, the user has to be notified if a "near-end" state arises next time; accordingly, the "no-display" mode is cancelled.

As described above, whether the information about the consumables, which information is acquired from the Printing Apparatus 2, is to be displayed is determined based on the setup information stored in the storage unit 12.

That is, when the residual quantity acquired by the residual quantity acquisition section 210 of at least one item of the consumables meets predetermined conditions that the user should be notified, the information about the consumables is displayed; otherwise, the process is finished without displaying the information about the consumables.

In addition, the residual quantity acquisition section 210 uses SNMP, Web Service, and the like when acquiring information indicating that a residual quantity of the toner is in one of the "near-end" and "end" states from the Printing Apparatus 2 at step S21. Alternatively, other protocols including an original protocol may be used.

(Example of (3) Residual Quantity Display Operation)

Figure 7:
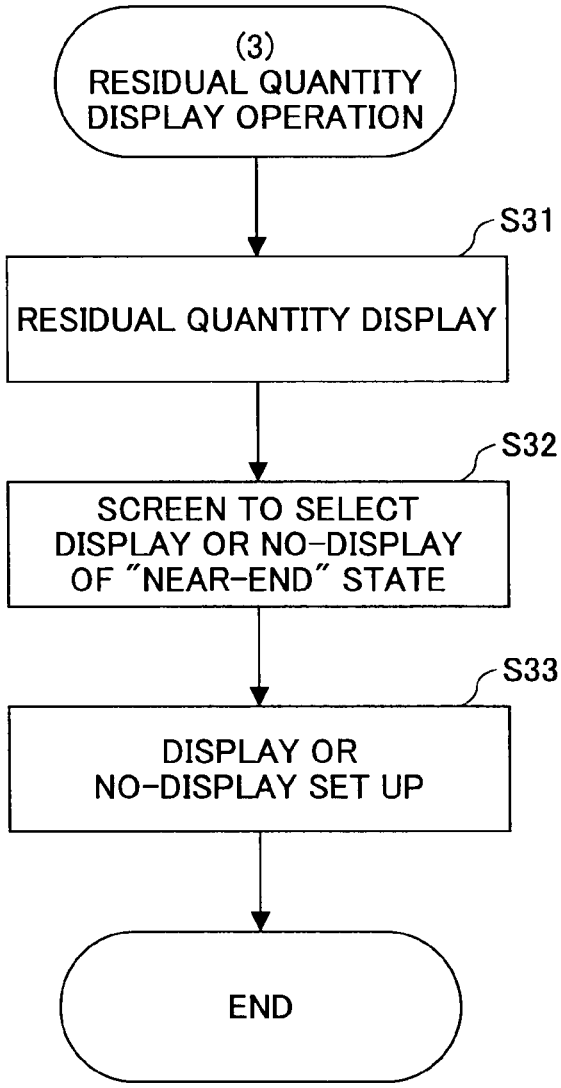
FIG. 7 is a flowchart of (3) a residual quantity display operation according to Embodiment 1.

An example of a residual quantity display operation of displaying the information about the consumables is described with reference to FIG. 7. Here, if at least one residual quantity (e.g., the residual quantity of the K toner) is determined to fulfill the display condition at step S22, the display operation is carried out.

First, the screen displaying section 232 displays the information about the consumables, specifically the residual quantity here in this example, on a dialog box, a warning screen, etc. (S31). Further, the parameter setting screen displaying section 231 displays the no-display specifying screen (refer to FIG. 9) so that whether the "no-display" mode should be activated can be decided so that information about the consumables is not displayed even if the residual quantity of the toner of K meets the conditions to notify the user at the time of the next printing execution (S32). Here, in this example, the no-display specifying screen (refer to FIG. 9) prompts the user to specify whether the "no-display" mode is to be activated so that the display is not made even if the residual quantity of the toner of K is in the "near-end" state at the time of the next printing execution when the information about the consumables is next acquired.

Then, the user operates the inputting unit 13 for specifying the "no-display" mode or otherwise as prompted at step S32. Then, at step S33, the storage controlling unit 240 specifies the "no-display" mode or otherwise in the storage unit 12 based on the user input from the inputting unit 13 (S33). According to the example, if a check box is checked by the user in the no-display specifying screen, the "no-display" is activated even if the residual quantity of the toner of K is in the "near-end" state.

With the operations above, the information about the consumables is displayed if at least one residual quantity of the consumables, for example, the toner of K, is determined to meet the condition to notify the user at step S22 of the (2) residual quantity display conditions determining operation.

Further, the no-display specifying screen for specifying the "no-display" mode of the information about the consumables is provided (S32) so that the information is not displayed at the time of the printing execution next time even if the condition to display is met by at least one item of the consumables.

The operations of Embodiments of the present invention provide an advantage in that the information about the consumables, such as the residual quantity of the consumables, can be effectively displayed. Specifically, the display of the state wherein the residual quantity of the consumables is "near-end" can be disabled such that the display is presented at a timing desired by the user, that is, an annoying repetition of the display is restricted.

(Example 2 of the Consumables Residual Quantity Display Operation)

The example 1 of the operation is described about the case where the consumables residual quantity display software 21A is invoked for the first time, and it is presupposed that the "no-display" mode is cancelled. In Example 2 here, it is presupposed that the "no-display" mode is activated, and further, the residual quantity of the toner in K color is the "near-end" state, while toners in other colors are in normal state as of the last printing execution (that is, as of the time when the latest information about the consumables is acquired by the residual quantity acquisition section 210).

In Example 2, the (1) parameter changing operation, and the (3) residual quantity display operation are the same as Example 1; accordingly, the descriptions are not repeated. Description follows as for (2) residual quantity display condition determining operation of Example 2 with reference to FIG. 6.

(2-1) The case wherein the toner of K color is in the "near-end" state, and other toners in C, M, and Y colors are in normal state (i.e., the same as the last time) is described. First, the residual quantity acquisition section 210 acquires the residual quantity of the consumables from the Printing Apparatus 2 (S21). Here, when printing is executed, the residual quantities of the toners in the four colors (K, C, M, Y) are acquired from the Printing Apparatus 2.

Then, the process determining section 220 determines whether at least one residual quantity of the consumables acquired by step S21 meets the display condition, i.e., "near-end" or "end" state (S22). Here, since the "no-display" is activated concerning the residual quantity of all the toners in the storage unit 12, it is determined that no display should be provided (NO at S22), and the process moves to step S24.

At step S24, the process determining section 220 determines whether the condition of "no-display" at the "near-end" state is to be cancelled (S24). For the same result as the latest printing execution, it is determined that the "no-display" at the "near-end" state is not to be cancelled (NO at S24), and the process is finished without changing.

As described above, if the situation is the same as the latest printing execution (that is, when the information about the consumables is acquired by the residual quantity acquisition section 210), the process is finished without displaying the information about the consumables acquired from the Printing Apparatus 2, and the like. In this way, the conventional inconvenience that warning is repetitively displayed each time when the "near-end" state is detected is cancelled.

(2-2) When K is in the "end" state and C, M, and Y are in the normal state is described.

First, the residual quantity acquisition section 210 acquires the residual quantities of the consumables from the Printing Apparatus 2 (S21). Here, the residual quantities of the toners of the four colors (K, C, M, and Y) are acquired from the Printing Apparatus 2 when printing is executed.

Then, the process determining section 220 determines whether at least one of the residual quantities acquired at step S21 meets the display condition, i.e., either in the "near-end" state or the "end" state (S22). Since the toner of K color is in the "end" state in this example, the determination at S22 is YES. Accordingly, the process moves to step S23.

At step S23, the storage controlling unit 240 cancels the "no-display" mode that is set up in the storage unit 12, which "no-display" mode is for the case where the residual quantity of the consumables is in the "near-end" state. According to the example, since the "no-display" in the case where the residual quantity of the toner of K is in the "near-end" state is activated, the "no-display" mode is canceled and the process is finished. Then, the process moves to the (3) residual quantity display operation.

In this way, the information about the consumables, which information is acquired from the Printing Apparatus 2, and the like, is displayed. Here, since the "no-display" mode is activated for each state of the residual quantity of the consumables (that is, the "near-end" and "end" states), the state of the toner of K, which is "end" in this example, can be displayed.

(2-3) The case where the toner of K color is in the "end" state, the toner of C color is in the "near-end" state, and the toner of M and Y colors are in the normal state is described.

First, the residual quantity acquisition section 210 acquires the residual quantity of the consumables from the Printing Apparatus 2 (S21). Here, the residual quantities of the toners of four colors (K, C, M, and Y) of the Printing Apparatus 2 are acquired when printing is executed.

Then, the process determining section 220 determines whether at least one of the residual quantities acquired at step S21 meets the display condition (either "near-end" or "end" state) such that the user should be notified (S22). Here, the residual quantities of the toners are measured with reference to the corresponding "near-end" threshold values stored in the storage unit 12. According to the example, since the toner of C color has lately become in the "near-end" state (or "end" state), it is determined that the user should be notified (YES at S22), and the process moves to step S23.

At step S23, the storage controlling unit 240 cancels the "no-display" mode for the "near-end" state of the residual quantity of the consumables, which setup is stored in the storage unit 12. Here, the "no-display" mode for the "near-end" state of the residual quantity of the toner of C is canceled, and the process is finished. Then, the process moves to the (3) residual quantity display operation.

In this way, the information about the consumables acquired from the Printing Apparatus 2, and the like, is displayed. Here, since the "no-display" mode is set up for each of the toners such as K and C, the residual quantity of the toner C can be displayed to provide warning of the "near-end" state to the user. Further, repetitive displays every time the "near-end" state is detected at subsequent printing operations can be avoided.

(2-4) The case wherein the toners of K, C, M, and Y colors are in the normal state is described.

First, the residual quantity acquisition section 210 acquires the residual quantities of the consumables from the Printing Apparatus 2 (S21). Here, the residual quantities of the toners of four colors (K, C, M, and Y) of the Printing Apparatus 2 are acquired when printing is executed.

Then, the process determining section 220 determines whether at least one of the residual quantities of the consumables acquired at step S21 meets the display condition (either in "near-end" or "end" state) so that the user should be notified (S22). Here, the residual quantities of the toners are measured with reference to the corresponding "near-end" threshold values of the toners, which values are stored in the storage unit 12. Since, according to the present example, the residual quantities of all the toners are greater than the corresponding "near-end" threshold value, that is, in the normal state (NO at S22), the process moves to step S24.

At step S24, the process determining section 220 determines whether the condition to cancel the "no-display" mode for the "near-end" state is fulfilled (S24). If it is determined that the condition to cancel the "no-display" mode is fulfilled (YES at S24), the process moves to step S25. The condition, if fulfilled, is to cancel the "no-display" mode that is stored in the storage unit 12. The condition is fulfilled if, for example, the residual quantities of all the toners are in the normal state, i.e., the residual quantities are greater than corresponding "near-end" threshold values. If the condition is fulfilled, a next "near-end" state of the residual quantity of the consumables should be communicated to the user; accordingly, the "no-display" mode is cancelled.

At step S25, the storage controlling unit 240 cancels the "no-display" mode stored in the storage unit 12 (S25), and the process is finished.

When the information indicating that the consumables are in normal supply is acquired from the Printing Apparatus 2, and the like, by the above operation, the "no-display" mode is cancelled without displaying the information about the consumables.

As described above, when the residual quantity of the consumables is greater than the "near-end" threshold value, such as when the consumables are supplemented or exchanged, as applicable, the "no-display" mode is cancelled. Otherwise, if it is not cancelled, the user will see the "end" warning without being pre-warned by the "near-end" warning.

Example 2 of the consumables residual quantity display operation is described about the case wherein the "no-display" mode for the "near-end" state of the residual quantity of the consumables is activated; however, the following operation may be additionally carried out. For example, the "near-end" warning display may be provided once in a while, not every time, when the information about the consumables is acquired by the residual quantity acquisition section 210.

In this way, even if the "no-display" mode is activated for the residual quantity of the consumables reaching the "near-end" state, the "near-end" state can be provided once in several times of acquiring the information about the consumables according to a predetermined rule.

For example, a counter is provided for counting the number of printing executions, which is equal to the number of times of acquiring the information about the consumables by the residual quantity acquisition section 210; when the count reaches a predetermined number, the process determining section 220 determines that the display condition is fulfilled even if the "no-display" mode is stored in the storage unit 12.

Further, a residual quantity acquisition control unit may be provided for periodically displaying the residual quantity of the consumables at a predetermined interval. In addition, the predetermined rule can take other forms, not limited to the cases described above.

Embodiment 2

Hereafter, Embodiment 2 of the present invention is described with reference to FIGS. 10 through 15.

(Network Configuration)

First, an example of the system and network configuration of Embodiment 2 is described with reference to FIG. 10.

Figure 10:
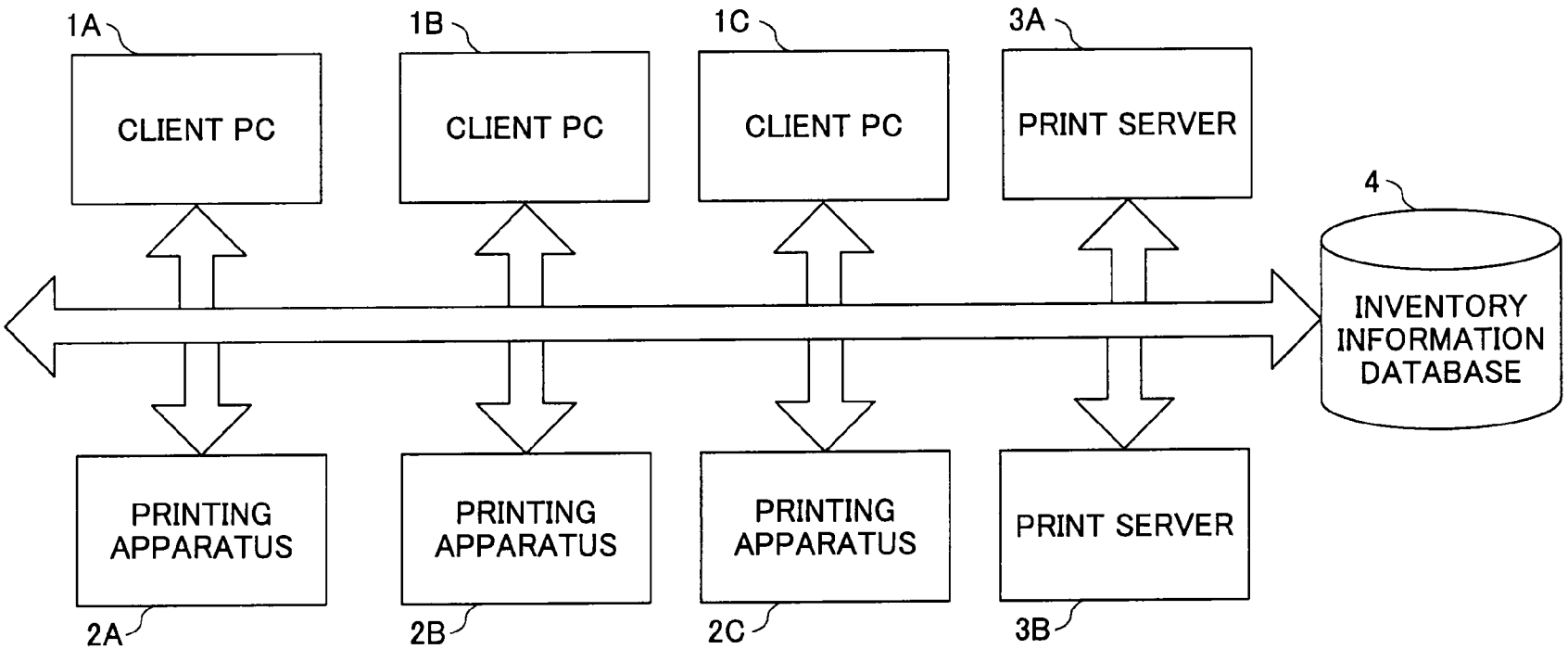
FIG. 10 is a block diagram of an example of the network configuration according to Embodiment 2.

According to Embodiment 2, the system includes an inventory information database 4 as shown in FIG. 10, which is different from Embodiment 1 as shown in FIG. 1. Accordingly, the inventory information database 4 is described.

The inventory information database 4 is for storing and managing inventory information about the consumables for the Printing Apparatus 2, which consumables include the toner and stacked paper in the paper feed tray.

(Configuration of Client PC)

The Client PC 1 is configured the same as in Embodiment 1, and descriptions are not repeated.

(Configuration of Consumables Residual Quantity Display Software)

Next, an example of the configuration of the consumables residual quantity display software 21A of the Client PC 1 according to Embodiment 2 is described with reference to FIG. 11. The consumables residual quantity display software 21A is a set of software modules contained in the application software 21 shown in FIG. 2. The consumables residual quantity display software 21A is application software for displaying the residual quantity information about the consumables (the toner, the stacked paper of the paper feed tray, and the like) of the Printing Apparatus 2.

Figure 11:
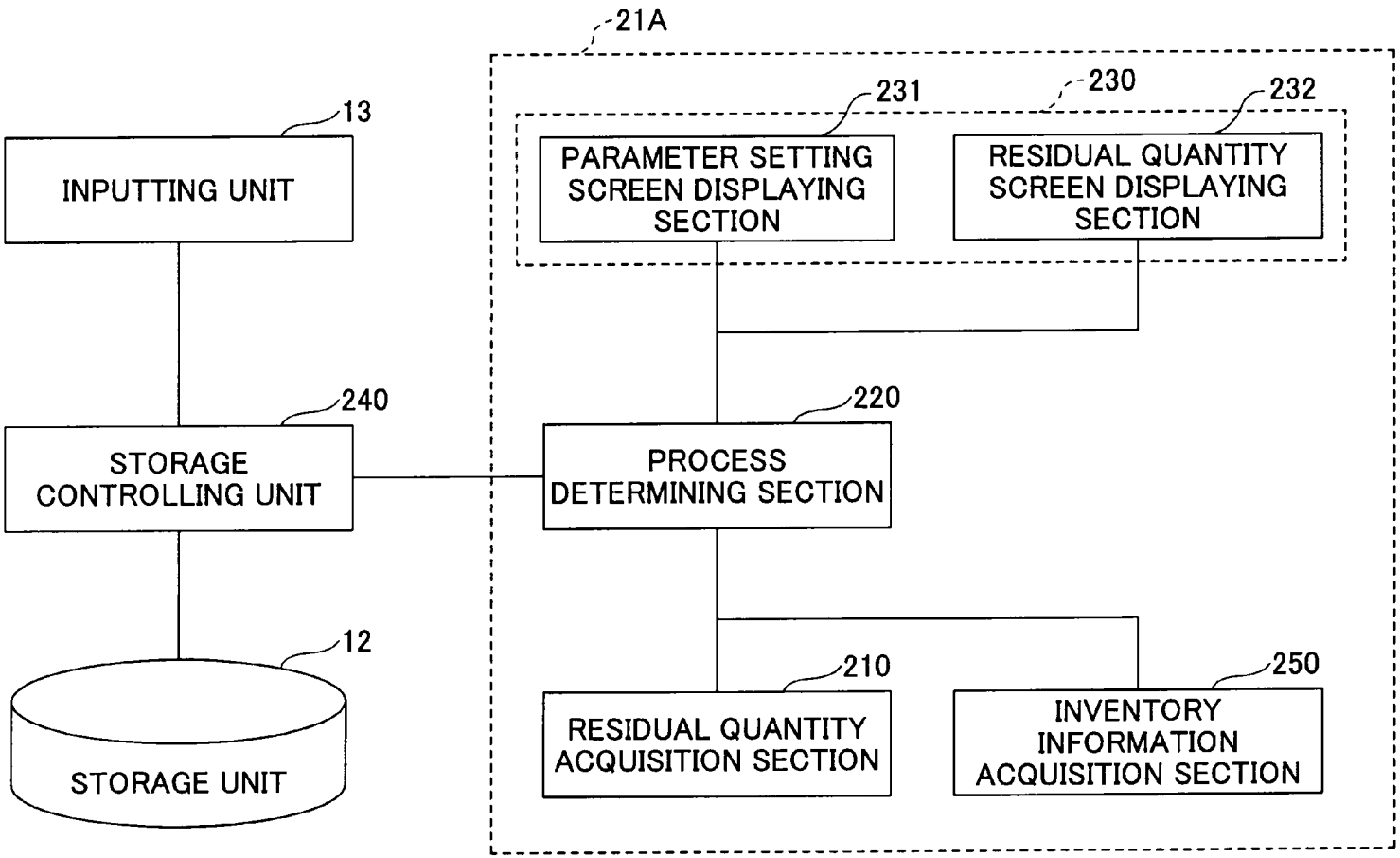
FIG. 11 is a block diagram of an example of the consumables residual quantity display software of the Client PC 1 according to Embodiment 2.

The consumables residual quantity display software 21A shown in FIG. 11 according to Embodiment 2 includes an inventory information acquisition section 250 in addition to what the consumables residual quantity display software 21A according to Embodiment 1 includes (refer to FIG. 3), which is the difference. Accordingly, the following descriptions focus on the inventory information acquisition section 250 and its associated functions.

The inventory information acquisition section 250 acquires inventory information about the consumables from the inventory information database 4, and the like. For example, inventory of the toner of a desired color and the stacked paper of a desired size of the Printing Apparatus 2 are acquired.

The process determining section 220 determines a process to be carried out (such as a process concerning displaying the inventory information about the consumables) according to the inventory information about the consumables acquired by the inventory information acquisition section 250 in addition to Embodiment 1. Details are given below when the residual quantity display condition determining process is described.

Figure 15:
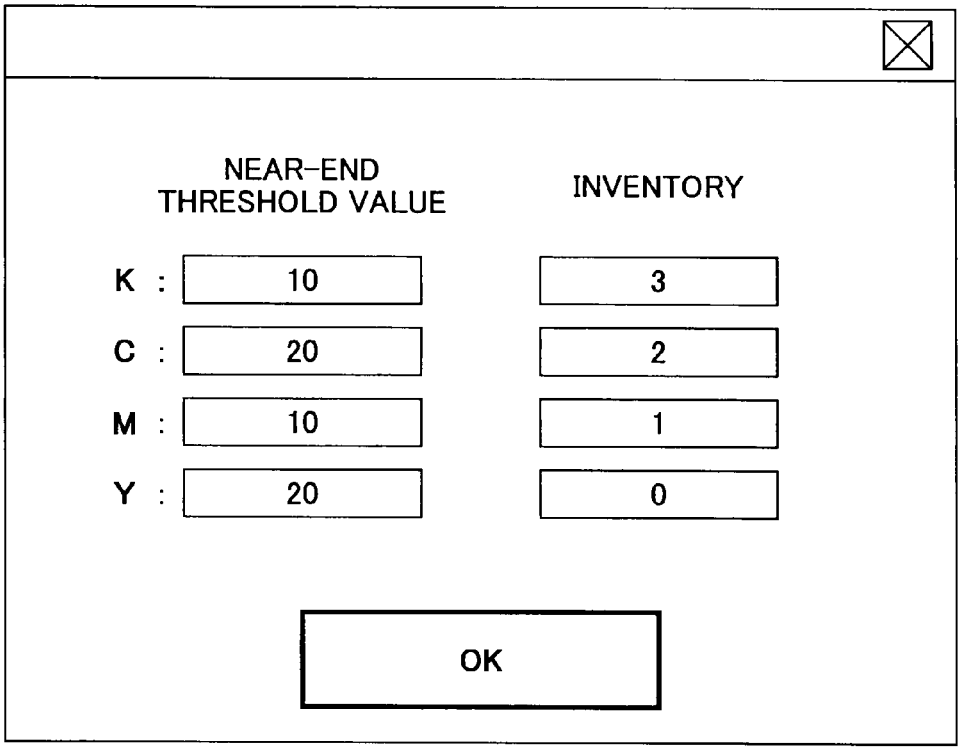
FIG. 15 is a schematic diagram of an example of the screen provided by the parameter setting screen displaying section 231 according to Embodiment 2.

The parameter setting screen displaying section 231 displays a setting screen, for example, as shown in FIG. 15. The setup information such as the "near-end" threshold value and the inventory information for every toner are displayed in the setting screen. Furthermore, an interface for prompting a change (or an input) of the setup information and the inventory information may be provided in the setting screen displayed. The setting screen with such an interface is henceforth called a parameter changing screen.

As described above, according to the consumables residual quantity display software 21A of Embodiment 2, in addition to what is acquired according to Embodiment 1, the inventory information about the consumables is acquired by the inventory information acquisition section 250, which inventory information is stored in the inventory information database 4.

Here, the inventory information acquisition section 250 may request the Printing Apparatus 2 to provide the inventory information about the consumables. In this case, the Printing Apparatus 2 acquires the inventory information from the inventory information database 4, and provides the acquired inventory information to the Client PC 1.

The consumables residual quantity display software 21A is invoked by, e.g., directly specifying the directory where the software is stored, and pointing and clicking on an icon displayed on the display unit 14 of the Client PC 1.

The consumables residual quantity display software 21A described above may be stored in a recording medium such as a CD-ROM disk and a floppy disk as one or more files. The consumables residual quantity display software 21 A stored in the recording medium is read by the recording-medium reading unit 15, copied in a format required for the storage unit 12, and installed in the Client PC 1. However, the program (consumables residual quantity display software 21A) may be provided through a transmission medium such as a communication circuit and a network.

In addition, an arrangement can be made such that functions realized by the consumables residual quantity display software 21A may be provided by the printer driver 23 of FIG. 2. In this case, the consumables residual quantity display software 21A can be invoked by inputting a direction to execute this software on the screen provided by the printer driver 23. In this case, the executing of the software and printing directions are not synchronized; nevertheless, it is possible to arrange such that the software may be invoked in sync with a printing direction to print data generated using the application software 21.

Further, may be installed in the Print Server 3 shown in FIG. 1. This is suitable when, for example, the functions of the consumables residual quantity display software 21A are offered in network environments such as the Web. Further, the consumables residual quantity display software 21A may be installed in the Printing Apparatus 2 as shown in FIG. 1. In this case, the residual quantity can be displayed on the console panel of the Printing Apparatus 2, which provides further convenience to the user.

(Outline of the Consumables Residual Quantity Display)

The outline of the consumables residual quantity display is the same as Embodiment 1 (refer to FIG. 3), and descriptions are not repeated.

(Example 1 of the Consumables Residual Quantity Display Operation)

Figure 12:
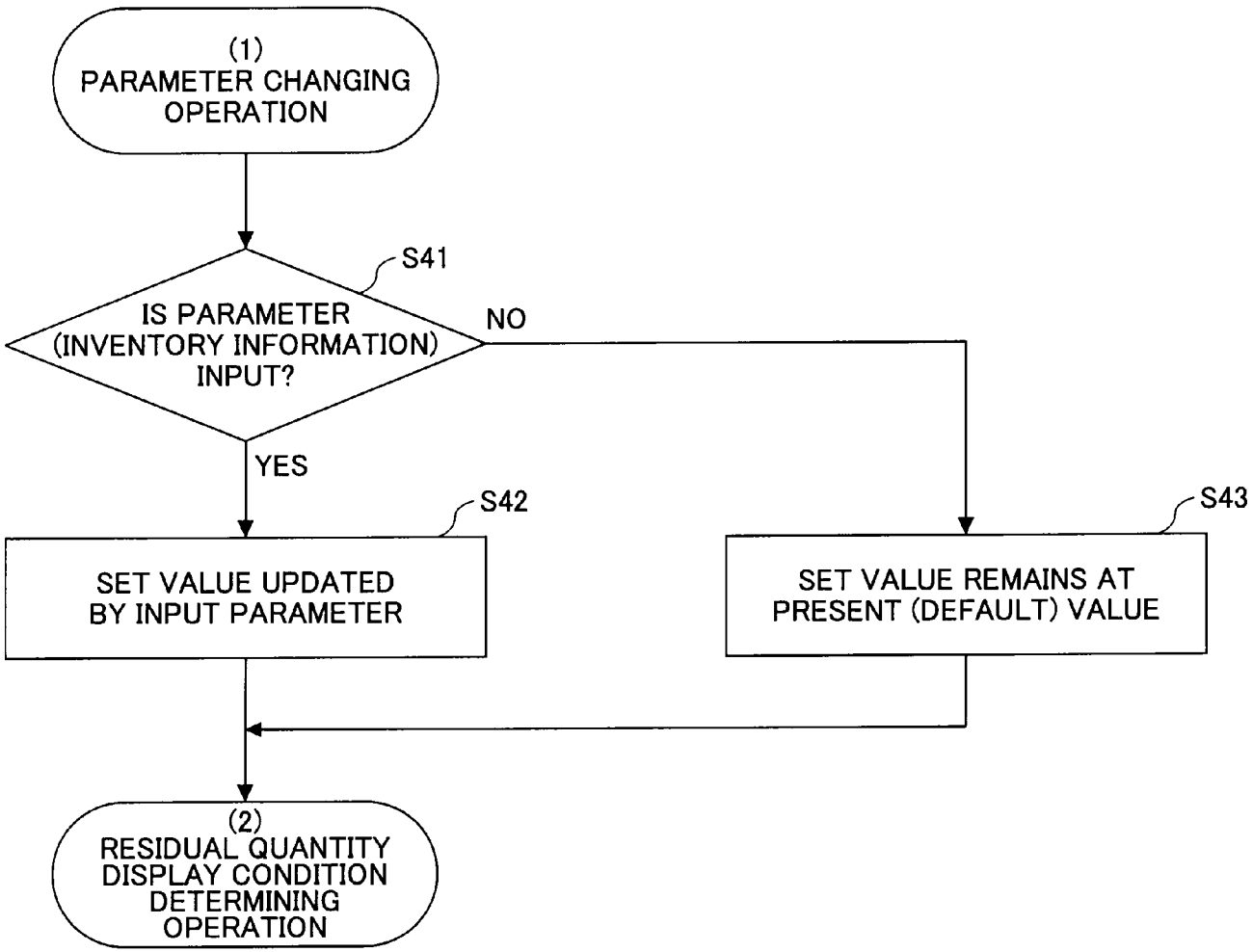
FIG. 12 is a flowchart of (1) the parameter changing operation according to Embodiment 2.
Figure 13:
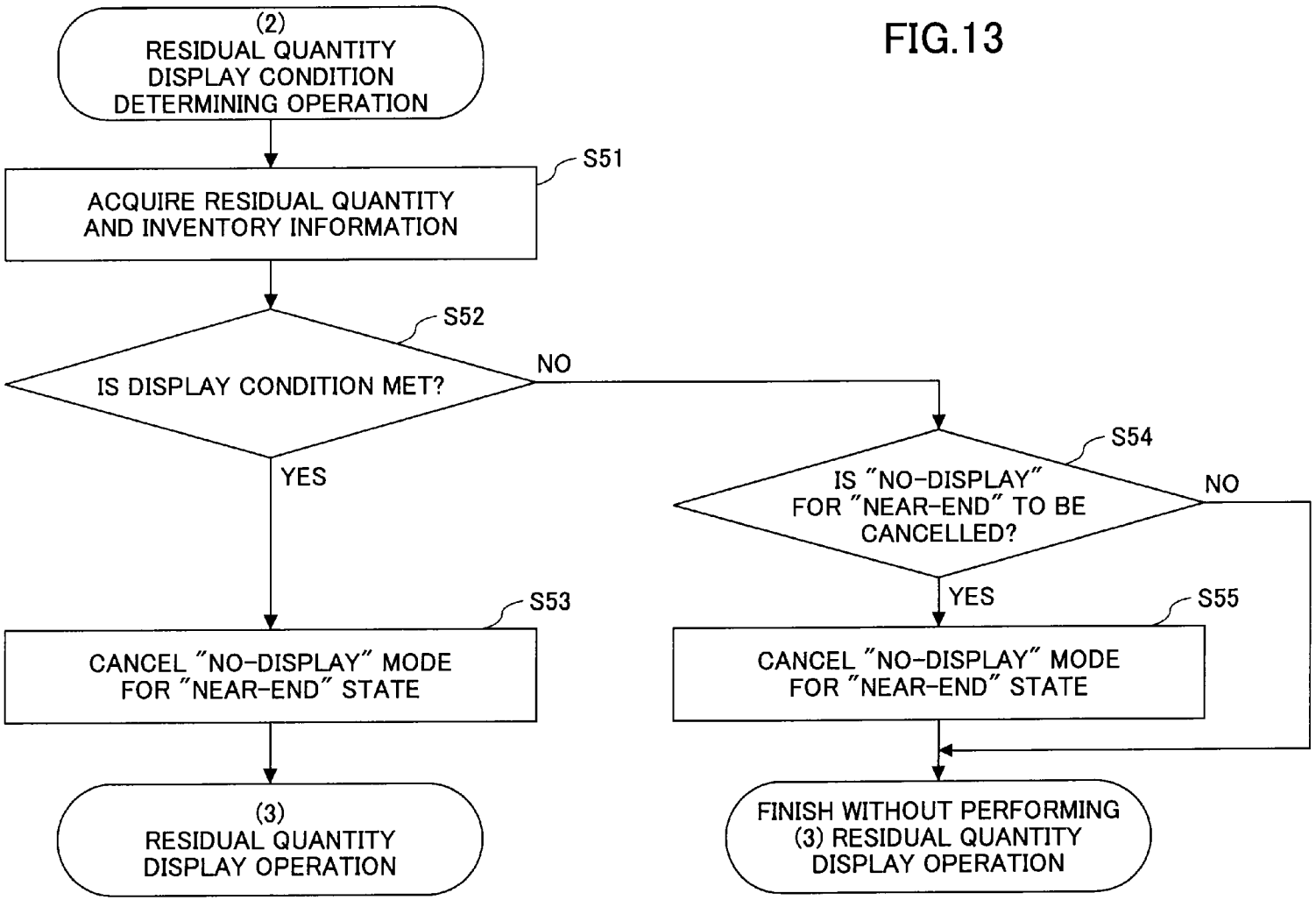
FIG. 13 is a flowchart of (2) the residual quantity display condition determining operation according to Embodiment 2.
Figure 14:
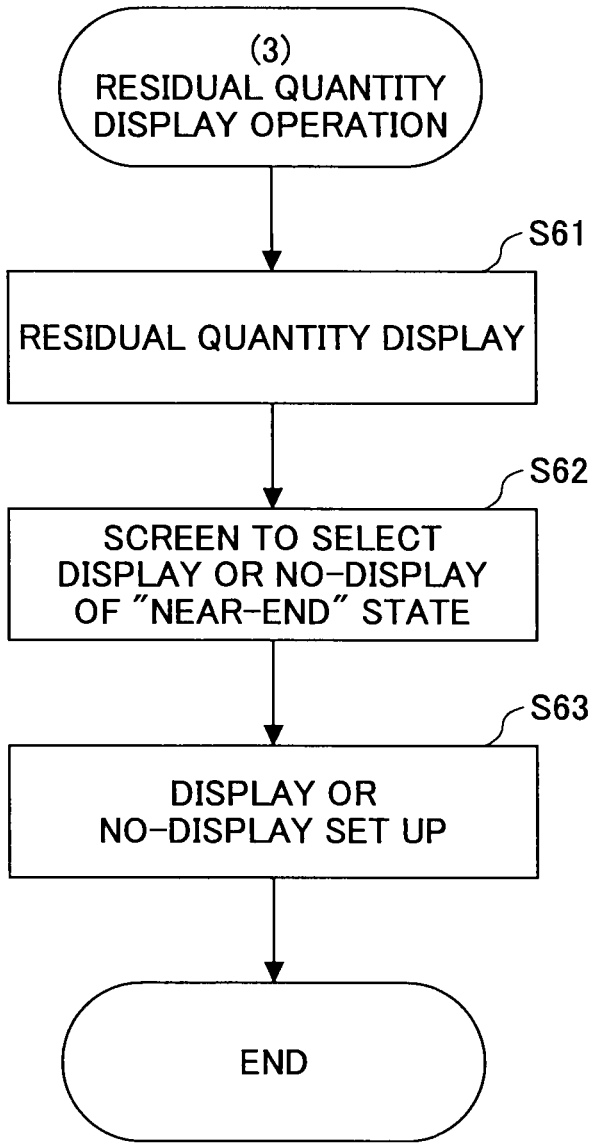
FIG. 14 is a flowchart of (3) the residual quantity display operation according to Embodiment 2.

Example 1 of the operations (1) through (3) is described with reference to FIGS. 12 through 14.

Here, the case wherein the consumables residual quantity display software 21A is invoked for the first time is described. The "near-end" threshold values used in the consumables residual quantity display can be specified by the user. Further, given that the software is invoked for the first time, it is assumed that the "no-display" mode in the case wherein the residual quantity of the consumables is in the "near-end" state is canceled. Furthermore, it is assumed that the inventory information used in the consumables residual quantity display is available from the inventory information database 4, or alternatively, provided by the user.

Here, the following descriptions focus on a difference from Embodiment 1.

(Example of (1) Setting Change Operation)

An example of an operation of changing the setup is described with reference to FIG. 12. Here, setup information stored in the storage unit 12 is changed by this operation based on an input by the user. The setup information, for example, includes inventory information.

First, the user inputs a setup value to the inputting unit 13 (S41). Here, if the user wishes to change the inventory information, the user inputs to the inputting unit 13 while the parameter changing screen (refer to the FIG. 15) is displayed. Here, the parameter changing screen as shown in FIG. 15 is displayed by the parameter setting screen displaying section 231. Details are given below where (3) residual quantity display operation is described.

When the user inputs at step S41 (YES at S41), the process moves to step S42, where the storage controlling unit 240 updates the inventory information stored in the storage unit 12 according to contents of the input at step S41 (S42).

If no input is made at step S41 (NO at S41), the process moves to step S43, where the storage controlling unit 240 finishes the process without changing the inventory information stored in the storage unit 12 (S43). In addition, if there is no "near-end" threshold value that can be changed, the same process as step S43 is performed.

The setup information stored in the storage unit 12 can be changed by the operations described above based on the input by the user. Here, the setup information changed by the operation includes the inventory information.

(Example of (2) Residual Quantity Display Conditions Determining Operation)

An example of an operation of determining whether the information about the consumables is to be displayed is described with reference to FIG. 13. Here, whether the information about the consumables acquired from the Printing Apparatus 2 is to be displayed is determined based on the setup information stored in the storage unit 12. The information about the consumables is, for example, the residual quantity of the toner of each color (K, C, M, and Y). The information may include the residual quantity of the stacked paper in the paper feed tray.

First, the residual quantity acquisition section 210 acquires the residual quantity of the consumables from the Printing Apparatus 2. Further, the inventory information acquisition section 250 acquires the inventory information (numbers in inventory) about the consumables from the inventory information database 4 (S51). When printing is executed, the residual quantity and the number in inventory of each of the toners of the four colors (K, C, M, and Y) of the Printing Apparatus 2 are acquired.

Then, the process determining section 220 determines whether at least one residual quantity of the consumables acquired by step S51 meets the display condition, i.e., is in the "near-end" or "end" state such that the user should be notified (S52). Here, the residual quantity of each toner is measured with reference to the "near-end" threshold value assigned to the toner, which value is stored in the storage unit 12. If one or more toners are in the "near-end" or "end" state, and if the corresponding number in inventory acquired by step S51 is less than the corresponding quantity of the toner stored in the storage unit 12, it is determined that the user should be notified (YES at S52), and the process moves to step S53. If all the states are normal, that is, if the residual quantities of all the toners are greater than the corresponding "near-end" threshold values, and if the corresponding numbers in inventory of the toners acquired by step S51 are greater than the corresponding quantities of toners stored in the storage unit 12, it is determined that the user should not be notified (NO at S52), and the process moves to step S54.

At step S53, the storage controlling unit 240 cancels the "no-display" mode for the "near-end" state of the residual quantities of the consumables stored in the storage unit 12 (S53). Here, since it is given that the "no-display" mode for the "near-end" state is canceled, the process is finished without changes.

At step S54, the process determining section 220 determines whether the "no-display" mode for the "near-end" state should be cancelled (S54). If it is determined that the "no-display" mode should be cancelled (YES at S54), the process moves to step S55. Otherwise, if it is determined that the "no-display" mode should not be cancelled (NO at S54), the process is finished without changes. The "no-display" mode stored in the storage unit 12 is cancelled if, for example, all the toners are in the normal condition, that is, the residual quantities of all the toners are greater than the corresponding "near-end" threshold values.

At step S55, the storage controlling unit 240 cancels the "no-display" mode for the "near-end" state of the residual quantity of the consumables, which setup is stored in the storage unit 12 (S55), and the process is finished. In this way, when, for example, the toners are resupplied, the next "near-end" state is reported to the user.

As described above, whether the information about the consumables acquired from the Printing Apparatus 2 is to be displayed is determined by the above operations based on the setup information stored in the storage unit 12.

That is, when at least one set of information about the consumables acquired by the residual quantity acquisition section 210 fulfills a predetermined condition for the user to be notified, the information about the consumables is displayed; otherwise, if the predetermined condition is not fulfilled, the process is finished without displaying the information about the consumables.

Here, although SNMP, Web Service, etc., are used when acquiring the "end" state or "near-end" state of the toner from the Printing Apparatus 2, other protocols may be used.

(Example of (3) Consumables Information Display Operation)

An example of the consumables information display operation is described with reference to FIG. 14. This operation is performed after steps S51 through S53 of the (2) residual quantity display conditions determining operation, especially when it is determined that at least one set of information about the consumables, for example, the toner of K color, should be reported to the user at step S52.

The residual quantity screen displaying section 232 displays the information about the consumables in a dialog box, a warning screen, and the like, which information is the residual quantity in this example (S61). Then, the parameter setting screen displaying section 231 displays the no-display specifying screen (such as shown in FIG. 9 for Embodiment 1) so that a user selection is prompted, which selection is whether to display the information about the consumables (e.g., the residual quantity of the toner of K) when the display condition is fulfilled at the next printing execution (S62). Specifically, in the present example, the no-display specifying screen is displayed wherein the "no-display" mode for the residual quantity of the toner of K being in the "near-end" state is prompted by the check box.

Then, at step S63, a selection is input by the user to the no-display specifying screen provided at step S62 through the inputting unit 13, and the "no-display" mode stored in the storage unit 12 is changed by the storage controlling unit 240 based on the input from the inputting unit 13 (S63). Here, if a check is entered in the check box by the user in the no-display specifying screen, the "no-display" mode for the residual quantity of the toner of K being in the "near-end" state is set up.

As described, by the process at step S52 of the (2) residual quantity display conditions determining operation, the information about the consumables is determined to be displayed so that the user is notified when it is determined that the display condition is fulfilled concerning at least one set of information of the consumables (e.g., the residual quantity of the toner of color K).

Furthermore, by the process at step S52, the no-display specifying screen is displayed for prompting the "no-display" mode selection; if "no-display" is selected, the information about the consumables is not displayed at the next printing execution even if the display condition of at least one set of the information about the consumables is fulfilled.

The operations described above provide an advantage in that the inventory information about the consumables in association with the residual quantity display of the consumables in addition to the advantage of Embodiment 1. That is, the user is notified not only when the residual quantities of the consumables turn either the "near-end" state or the "end" state, but also when the numbers in inventory of the consumables are decreased such that the user can perform inventory control according to the inventory information about the displayed consumables.

Further, the present invention is not limited to the Embodiments, but variations and modifications may be made without departing from the scope of the present invention.

The present application is based on Japanese Priority Application No. 2007-045714 filed on Feb. 26, 2007 with the Japanese Patent Office, the entire contents of which are hereby incorporated by reference.

What is claimed is:

1. A terminal apparatus capable of communicating with a printing apparatus through a network, the terminal apparatus comprising:

an acquisition unit for acquiring information about the residual quantity of a consumable of the printing apparatus from the printing apparatus;

a first determining unit for determining whether the consumable is in a first state or a second state based on the acquired residual quantity;

a storing unit for storing a setting indicating whether to display information about the consumable in the first state;

a second determining unit for determining whether to display information about the consumable in the first state, based on the stored setting;

a first display change unit for changing a display, when the consumable is in the first state, from a "display" mode in which the first state is displayed to a "no-display" mode in which the first state is not displayed; and a second display change unit for changing the display, when the consumable is in the second state, from the "no-display" mode to the "display" mode.

2. The terminal apparatus as claimed in claim 1, further comprising a third display change unit for changing the display, when said first determining unit determines that the consumable is not in the first state or a second state, from the "no-display" mode to the "display" mode.

3. The terminal apparatus as claimed in claim 2, wherein the third display change unit changes the display from the "no-display" mode to the "display" mode when the acquisition unit acquires information from the printing apparatus indicating that the consumables of the printing apparatus are in normal supply.

4. The terminal apparatus as claimed in claim 3, wherein the information about the consumables which is acquired by the acquisition unit is displayed according to a predetermined rule even when the display is in the "no-display" mode.

5. The terminal apparatus as claimed in claim 1, wherein the information about the consumable acquired by the acquisition unit includes a residual quantity of a toner of the printing apparatus being less than a predetermined threshold value, and a residual quantity of stacked paper in a paper feed tray of the printing apparatus being less than a predetermined threshold value.

6. The terminal apparatus as claimed in claim 1, further comprising:

a consumable inventory control apparatus that manages inventory information about the consumable; wherein the consumable inventory control apparatus is connected to the terminal apparatus through the network, the acquisition unit acquires the inventory information from the consumable inventory control apparatus, and displays the inventory information acquired by the acquisition unit is displayed by the display.

7. A computer-readable, non-transitory recording medium that stores a consumable residual quantity display program for performing processes of a terminal apparatus capable of communicating with a printing apparatus through a network, the terminal apparatus comprising:

an acquisition unit for acquiring information about the residual quantity of a consumable of the printing apparatus from the printing apparatus;

a first determining unit for determining whether the consumable is in a first state or a second state based on the acquired residual quantity;

a storing unit for storing a setting indicating whether to display information about the consumable in the first state;

a second determining unit for determining whether to display information about the consumable in the first state, based on the stored setting;

a first display change unit for changing a display, when the consumable is in the first state, from a "display" mode in which the first state is displayed to a "no-display" mode in which the first state is not displayed; and a second display change unit for changing the display, when the consumable is in the second state, from the "no-display" mode to the "display" mode.

8. The computer-readable, non-transitory recording medium as claimed in claim 7, wherein the terminal apparatus further comprises third display change unit for changing the display, when said first determining unit determines that the consumable is not in the first state or a second state, from the "no-display" mode to the "display" mode.

9. The computer-readable, non-transitory recording medium as claimed in claim 8, wherein the third display change unit changes the display from the "no-display" mode to the "display" mode when the acquisition unit acquires information from the printing apparatus indicating that the consumables of the printing apparatus are in normal supply.

10. The computer-readable, non-transitory recording medium as claimed in claim 9, wherein the information about the consumables which is acquired by the acquisition unit is displayed according to a predetermined rule even when the display is in the "no-display" mode.

11. The computer-readable, non-transitory recording medium as claimed in claim 7, wherein the information about the consumable acquired by the acquisition unit includes a residual quantity of a toner of the printing apparatus being less than a predetermined threshold value, and a residual quantity of stacked paper in a paper feed tray of the printing apparatus being less than a predetermined threshold value.

12. The computer-readable, non-transitory recording medium as claimed in claim 7, wherein the terminal apparatus is connected to a consumable inventory apparatus through the network, and the consumable inventory control apparatus manages inventory information about the consumable; and wherein the acquisition unit acquires the inventory information from the consumable inventory control apparatus, and displays the inventory information acquired by the acquisition unit is displayed by the display.

* * * * *